United States Patent [19]

Kestner, Jr. et al.

[11] 4,381,988

[45] May 3, 1983

[54] FINE PARTICULATE REMOVAL FROM OIL SHALE ON A TRAVELLING GRATE RETORT

[75] Inventors: Daniel W. Kestner, Jr., Coraopolis, Pa.; Frank Forbes, Lakewood, Colo.

[73] Assignee: Dravo Corporation, Pittsburgh, Pa.

[21] Appl. No.: 285,060

[22] Filed: Jul. 20, 1981

[51] Int. Cl.[3] ..... C10G 1/00; C10B 49/06; C10B 53/06

[52] U.S. Cl. ..... 208/11 R; 201/32

[58] Field of Search ..... 208/11 R; 201/6, 32, 201/40

[56] References Cited

U.S. PATENT DOCUMENTS

| | | | |
|---|---|---|---|
| 1,906,755 | 5/1933 | Karrick | 201/32 X |
| 3,434,931 | 3/1969 | Mansfield | 201/32 |
| 3,441,480 | 4/1969 | Ban | 208/8 X |
| 3,483,115 | 12/1969 | Haddad et al. | 208/11 R |
| 3,560,368 | 2/1971 | Rowland et al. | 208/11 R |
| 3,560,369 | 2/1971 | Rowland et al. | 208/11 R |
| 3,644,193 | 2/1972 | Weggel et al. | 208/11 R |
| 4,039,427 | 8/1977 | Ban | 208/11 R |
| 4,141,793 | 2/1979 | Aoki et al. | 201/32 X |
| 4,149,939 | 4/1979 | Solano | 201/32 X |
| 4,162,960 | 7/1979 | Dhondt | 208/11 R |
| 4,200,517 | 4/1980 | Chalmers et al. | 208/11 R |

*Primary Examiner*—Delbert E. Gantz
*Assistant Examiner*—Glenn A. Caldarola
*Attorney, Agent, or Firm*—Parmelee, Miller, Welsh & Kratz

[57] ABSTRACT

In a process for the removal of fines from a bed of oil bearing shale in a travelling grate retort, a fluid such as air, inert gas or process gas is drafted through the bed in order to entrain in the fluid substantially all of the fines in the bed. The fines are then evacuated from the bed thus increasing the permeability of the bed and substantially decreasing the fines in the retorted shale oil.

7 Claims, 6 Drawing Figures

FINE PARTICULATE REMOVAL FROM OIL SHALE ON A TRAVELLING GRATE RETORT

BACKGROUND OF THE INVENTION

1. Field of the Invention

The invention relates to the removal of the fines from the oil shale bed on a travelling grate retort.

2. Prior Art

Oil bearing shale may be retorted to recover shale oil by processing the shale in a retort. Among the variety of retorts known in the art, travelling grate retorts, both circular and straight have gained prominence in oil shale retorting technology. In order to obtain the optimum quality shale oil from any retort, it is necessary to reduce the particulate content of the oil to as low a level as is possible. Additionally, to maximize the retorting rate, the oil bearing shale should be as permeable as possible.

Typically, oil bearing shale is pre-sized prior to being placed on the retort, with the majority of the fine particles removed by screening. Due to the inherent limitations in screening techniques, some fine particles cling to and are mixed with the shale particles as the shale is charged onto the travelling grate. The oil shale bed on the travelling grate retort is quiescent during the process, with the oil bearing shale being transported through the various drying, heating, retorting, combustion, heat recovery and cooling zones as required on the travelling grate. The retorting process is driven by a perpendicular cross-flow of process gas or air as required for the particular function being performed. The cross-flow of process gas and/or air may entrain the remaining fine particles from the oil shale bed on the travelling grate. These entrained solids can then be deposited as contaminants in the collected shale oil. Post-retorting treatment is presently required to remove the solid particulate contaminants from the shale oil.

It is an object of this invention to remove the fines from the oil shale bed on a travelling grate retort prior to the actual retorting of the oil bearing shale so that the oil will not be contaminated with the particulate solids.

It is a further object of the invention to increase the permeability of the oil shale bed which will in turn, result in an increase in the rate of oil shale processing.

SUMMARY OF THE INVENTION

The invention is a process for the removal of fines from a bed of oil bearing shale which has been charged onto a travelling grate retort. The retort includes a plurality of shale processing zones through which the travelling grate carries the burden of oil bearing shale. The zones may include various drying, heating, retorting, combustion, heat recovery and cooling zones. According to this invention, a fluid which can be either air, inert gas or a process gas is passed through the bed prior to the retorting of the oil from the shale. The flow of fluid entrains substantially all of the fines in the burden. The fluid together with the entrained fines are evacuated from the travelling grate retort for disposal or processing as desired. The direction of the fluid flow may be either in the updraft or downdraft mode under pressure or suction. This sweep or vacuum may be accomplished simultaneously with drying or preheating for example, if applicable, for a specific oil shale.

DETAILED DESCRIPTION OF THE INVENTION

Figure 1A:
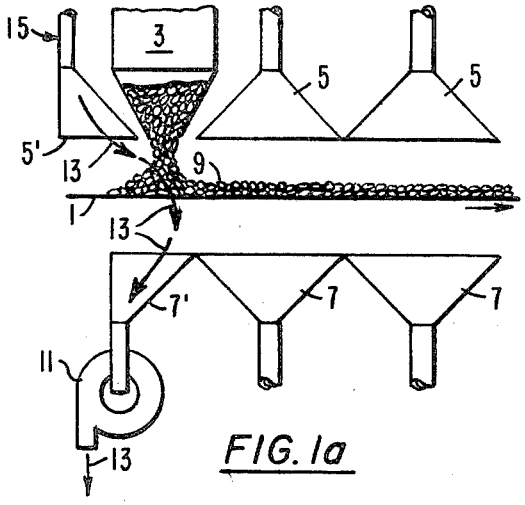
FIG. 1*a* is a schematic illustration of a section of a travelling grate retort incorporating the process of this invention in an embodiment in which fines are removed simultaneously with the charging of the burden onto the grate.

The inventive process described herein can be applied to either a straight travelling grate or a circular travelling grate as should be readily understood by those well versed in oil shale retorting technology. Accordingly, the section of a travelling grate retort illustrated in the several figures can be construed to be a section of a travelling grate of either configuration.

In each of the figures, a section of a travelling grate retort includes a travelling grate 1, a feed hopper 3 positioned above the grate 1, a plurality of processing hoods as at 5 disposed above the grate and a plurality of windboxes 7 below the grate 1. The feed hopper 3 charges oil bearing shale into the retort so that a bed 9 of shale is formed on the grate 1. The grate 1 then conveys the bed of shale 9 through a series of processing zones defined by opposing pairs of hoods 5 and windboxes 7. Means are provided in each of the retort's processing zones to effect the various steps required to retort oil from oil bearing shale. The zones include, for example various drying, heating, retorting, combustion, heat recovery and cooling zones. The specific configuration of zones will be dictated by the particular retorting process being utilized as well as the physical structure of the grate.

Figure 1B:
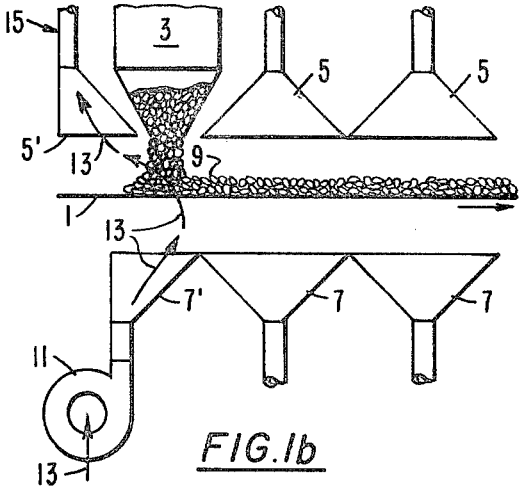
FIG. 1*b* is a schematic illustration of an alternative embodiment of the process of FIG. 1*a;*

In FIGS. 1*a* and 1*b* fines are removed from the bed 9 of oil bearing shale virtually simultaneously with the charging of the bed 9 onto the grate 1. In FIG. 1*a*, a means such as fan 11 is in communication with a windbox 7' disposed below the retort feed 3. The fan 11 drafts a fluid flow of either process gas, inert gas or air, as indicated by the arrows 13, down through a hood 5' as at 15 and into the bed 9. As the fluid flow 13 passes through the bed 9, substantially all of the fines in the oil bearing shale are entrained and evacuated from the bed 9 and grate 1. The entrained fines can be removed from the retort and disposed of, or for example, the fines can be agglomerated and returned to the feed hopper for processing in a conventional manner. The grate 1 is; of course, continuously travelling through the retort during the fines removal process of this invention.

As illustrated in FIG. 1*b*, it is possible to arrange a fan 11 in such a way as to generate an updraft of fluid through the grate 1 and burden 9. The fluid flow 13 will entrain substantially of all the fines in the bed 9 and evacuate the fines from the retort through a hood 5 as at 15 adjacent the feed 3 for disposal or agglomeration.

Figure 2A:
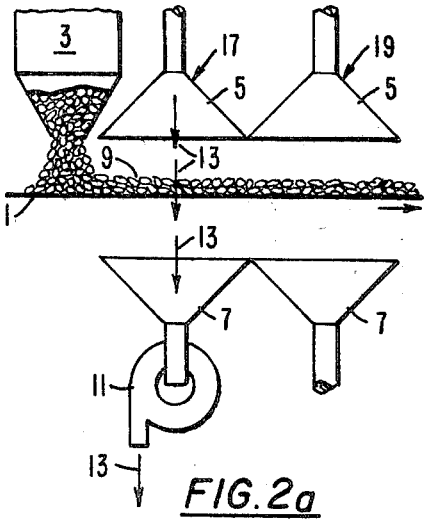
FIG. 2*a* is a schematic illustration of a section of a travelling grate retort incorporating the process of this invention in an embodiment in which fines are removed in a separate zone of the travelling grate retort.
Figure 2B:
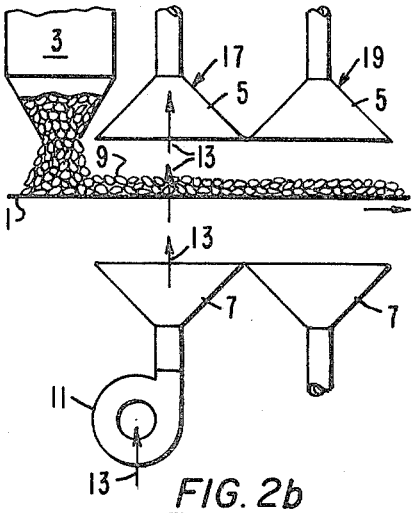
FIG. 2*b* is a schematic illustration of an alternative embodiment of the process according to FIG. 2*a;*

Turning to FIGS. 2*a* and 2*b*, a separate zone defined by a hood 5 and windbox 7 as at 17 is provided for the removal of fines from the bed 9. Such a separate zone 15 is preferably located between the feed 3 and the first conventional processing zone as at 19. In FIG. 2*a* the fluid flow of process gas, inert gas or air indicated by the arrow 13 passes down through the bed 9 and grate 1. The downdraft can be effected by either a pressure or suction as determined by the means used to generate the same. Again, for illustrative purposes only a fan 11 is shown in communication with the windbox 7 of zone 17. Conversely, as in FIG. 2*b*, the fluid flow 13 can be drafted from the windbox 7 up through the grate 1 and bed 9. In either embodiment, the fluid flow 13 entrains the fines and removes them from the bed and grate.

Figure 3A:
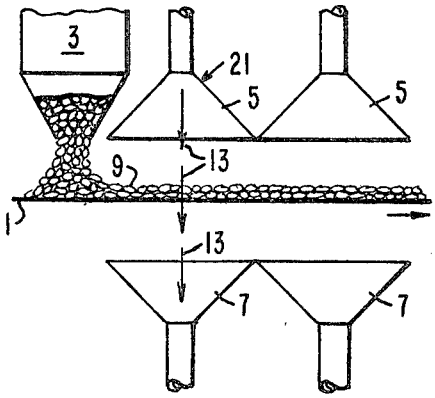
FIG. 3*a* is a schematic illustration of a section of a travelling grate retort incorporating the process of this invention in an embodiment in which fines are removed in one of the processing zones of the retort.
Figure 3B:
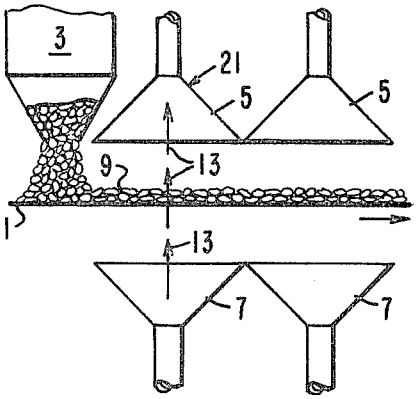
FIG. 3*b* is a schematic illustration of an alternative embodiment of the process of FIG. 3*a*.

Finally, in FIGS. 3*a* and 3*b*, the fines removal process is combined with the first processing zone of the retort as at 21. Typically, such a zone could be a drying or heating zone in which the bed is contacted with heated air or process gas shown by arrows 13. The updraft of fluid through the bed 9 as in FIG. 3*a* and the downdraft of fluid through the bed as in FIG. 3*b* can be effected by the apparatus used in the normal retorting process or additional means such as a fan (not illustrated) may be employed. In either event, it is necessary that sufficient force be imparted to the flow of air, inert gas or process gas so that the fines are entrained and evacuated from the bed. The entrained fines are removed for disposal as appropriate.

In all of the above described embodiments, the fines are removed from the bed of oil bearing shale prior to the actual retorting of the oil. The permeability of the shale bed is thus improved and the processing rate of the shale is also increased. Because the fines are removed prior to the liberation of the oil, post-retorting treatment of the oil to remove solid particulate contaminates is either greatly reduced or completely eliminated.

What is claimed is:

1. A process for the removal of fines from a bed of oil bearing shale on a travelling grate retort which includes a feed zone in which said shale is charged onto said grate to form said bed and a plurality of shale processing zones defined by hoods and windboxes disposed above and below the grate and through which said bed is carried by said travelling grate, said removal process being effected prior to the retorting of oil from said oil bearing shale in one of said processing zones by passing hot retorting gases through said bed to vaporize and carry off for condensation, the oil in the shale, said process comprising the steps of:

passing a flow of non-shale oil bearing fluid into said oil bearing shale at a temperature below retorting temperature to entrain in said flow substantially all of the fines in said bed; and evacuating said flow of fluid with said entrained fines from said bed while maintaining said flow separate from said hot retort gases whereby the amount of fines in the retorted shale oil is significantly decreased.

2. A process for the removal of fines from a bed of oil bearing shale according to claim 1 wherein the flow of fluid is updrafted through said travelling grate and then through said bed of oil bearing shale.

3. A process for the removal of fines from a bed of oil bearing shale according to claim 1 wherein the flow of fluid is downdrafted through the bed and then the travelling grate.

4. A process for the removal of fines from a bed of oil bearing shale according to claim 2 or 3 wherein the fluid is selected from the group consisting of process gas, inert gas and air.

5. A process for the removal of fines from a bed of oil bearing shale according to claim 4 wherein the fluid is drafted through said bed substantially simultaneously with the charging of the shale onto the travelling grate.

6. A process for the removal of fines from a bed of oil bearing shale according to claim 4 wherein the fluid is drafted through said bed in one of said plurality of zones between said feed zone and said processing zones prior to the entrance of the bed into the zone in which the oil is retorted from the shale.

7. A process for the removal of fines from a bed of oil bearing shale according to claim 4 wherein the travelling grate retort includes a hood and windbox disposed above and below the travelling grate respectively in addition to the hoods and windboxes which define the processing zones and between said processing zones and feed zone and wherein the process includes passing said fluid flow into said bed and evacuating said flow from said bed when said bed is interposed between said additional hood and windbox.

* * * * *